United States Patent [19]

Skrobul et al.

[11] 4,446,053

[45] May 1, 1984

[54] BETA-AMINO ACID DERIVATIVES AND FRICTION-MODIFIED LUBRICATING COMPOUNDS CONTAINING SAME

[75] Inventors: Anthony P. Skrobul, Beacon; Benjamin J. Kaufman, Wappingers Falls, both of N.Y.

[73] Assignee: Texaco Inc., White Plains, N.Y.

[21] Appl. No.: 439,160

[22] Filed: Nov. 4, 1982

[51] Int. Cl.[3] ..... C10M 1/36; C10M 1/54

[52] U.S. Cl. ..... 252/33.6; 252/51.5 A; 564/130; 562/553

[58] Field of Search ..... 252/33.6, 51.5 A; 564/130, 124; 562/553, 554

[56] References Cited

U.S. PATENT DOCUMENTS 3,985,805 10/1976 Norton ..... 564/124

*Primary Examiner*—Jacqueline V. Howard

*Attorney, Agent, or Firm*—Robert A. Kulason; Robert Knox, Jr.; James J. O'Loughlin

[57] ABSTRACT

Disclosed are beta-amino acid derivatives which impart friction reducing properties to lubricating compositions. The additives of the invention are bifunctional carboxylic acid salts and amides derived from the basic hydrolysis of a cyanoethylated amine.

6 Claims, No Drawings

BETA-AMINO ACID DERIVATIVES AND FRICTION-MODIFIED LUBRICATING COMPOUNDS CONTAINING SAME

BACKGROUND OF THE INVENTION

1. Field of the Invention

This invention relates to the art of reducing friction between the moving parts of an engine by means of modified lubricants.

Two concepts currently are being developed in order to decrease hydrocarbon fuel consumption in internal combustion engines. One approach has been to make extensive engineering changes by designing smaller, lighter and aerodynamically more efficient vehicles. The second approach to improving fuel economy is to provide energy saving lubricants containing certain additives which in conjunction with the oil component of the lubricant exert a cushioning effect between the moving parts of its engine, thereby decreasing frictional forces and reducing fuel consumption. The present invention is a further development of this latter approach.

2. Description of the Prior Art

The relevant prior art in this area includes U.S. Pat. No. 4,218,328 which discloses a process for preparing an acid neutralizing oil additive which comprises reacting an amino acid and a basically reacting metal compound in the presence of a suspending agent and of a hydroxylic promoter. The subject patent does not indicate that its products have any friction reducing properties. The amino acids disclosed in the patent include beta-amino acids and the basically reacting metal compound can be a Group I Metal Hydroxide or Group II Metal Oxide or Hydroxide. The suspending agent is an alkali metal or alkaline earth metal hydrocarbylsulfonate, a hydrocarbyl succinimide, a hydrocarbyl succininate, a hydrocarbyl succininate an hydride, and alkali metal or alkaline earth metal alkylphenate, a Mannich base or alkylene earth metal salt of a Mannich base. Although not an essential reactant in the patented process, it is preferred that the reaction take place in the presence of a chalcogen compound such as carbon dioxide or carbon disulfide.

SUMMARY

The friction reducing additives of this invention are characterized by the following general formulas:

$$RNHCH_2CH_2CO_2^-Na^+ \text{ and } RNHCH_2CH_2CONH_2$$

wherein R is a straight chain alkyl radical having from about 10 to 30 carbon atoms which may be unsubstituted or wherein the substitutable hydrogens are replaced by non-interferring substituents such as alkyl, cycloalkyl, or nitro groups.

DISCLOSURE

The preparation of the reaction product used in a lubricating composition according to the invention is relatively uncomplicated and can be economically conducted by the following reaction sequence resulting in the general structure shown:

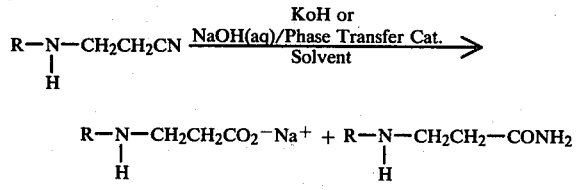

where R is as above.

The starting nitriles used in the above reaction sequence are prepared by the cyanoethylation of fatty amines: e.g., oleylamine, cocoamine, tallowamine, hydrogenated-tallowamine, soyaamine and mixtures thereof. Some of these cyanoethylated amines are commercially available materials or they may be synthesized by those skilled in the art. However, the synthesis of cyanoethylated amines does not constitute a part of this invention.

The amount of base used basis amine ranges from 1 to 10 equivalents. Suitable phase transfer catalysts include: quaternary ammonium halides, quaternary ammonium sulfates, crown ethers. Suitable solvents include toluene, mineral or synthetic oils used in the amount of at least 50% of the base end amine.

Examples of the subject compositions are illustrated in Examples below.

EXAMPLE I

To a 30 percent sodium hydroxide solution (300 ml) containing Aliquat 336 (a tricaprylmethylammonium chloride) (20 g) and toluene (1200 ml) was added 2-cyanoethyl Armeen 0 (180 g). 2-cyanoethyl Armeen O is commercially available from Armak Chemical Co. and has a primary amino group attached to the terminal carbon of the straight carbon chain. Its typical chain length distribution: saturated—below $C_{18}$ 9.5%; $C_{18}$ 5%; unsaturated $C_{14}$ 1.5%; $C_{16}$ 5%; oleyl $C_{18}$ 76% and linoleyl $C_{18}$ 3%. (180 g). The mixture was stirred and heated at 75° C. for 12 hours, after which time the sodium hydroxide solution was separated and the toluene stripped under reduced pressure to yield 208 g of product. The product was a clear amber fluid. The spectral properties and elemental analyses of the product are consistent with those expected for a mixture of the amide and the salt of 2-carboxyethyl Armeen O:IR (neat) 6.02M ($CONH_2$), % N (7.2) and % Na (1.0).

EXAMPLE II

To a 30 percent sodium hydroxide solution (50) ml containing tetrabutylammonium hydrogen sulfate (10 g) and toluene (200 ml) was added 2-cyanoethyl Armeen O (30 g). The mixture was stirred at 75° C. for 12 hours, the sodium hydroxide layer separated and the toluene stripped under reduced pressure to yield 36 g of a product whose IR spectrum was identical to that of Example I.

EXAMPLE III

Proceeding as in Examples I and II but using cyanoethylated cocoamine, a suitable product is obtained.

EXAMPLE IV

Preceding as in Examples I and II but using cyanoethylated tallowamine, a suitable product is obtained.

EXAMPLE V

Preceeding as in Examples I and II but using hydrogenated tallowamine, a suitable product is obtained.

EXAMPLE VI

Proceeding as in Examples I and II but using soyaamine and aqueous potassium hydroxide a suitable product is obtained.

Motor Oil Containing the Product of the Invention

To demonstrate the utility of the subject class of compounds as friction reducing additives in lubricants, the preparation of Example I was blended at 0.5 percent (by weight) into a commercial SAE 10W-40 motor oil which contained the following conventional additives (Table I):

TABLE I

| SAE 10W-40 Motor Oil Composition | |
|---|---|
| Additive | Dose, weight percent |
| Alkenylsuccinimide dispersant | 0.08 N |
| Overbased calcium sulfonate | 0.23 Ca |
| Polyethyoxylated alkylphenol | 0.15 |
| Zinc Dialkyldithiophosphate | 0.15 Zn |
| Diarylamine | 0.25 |
| Oil concentrate of a polymethacrylate | 0.10 |
| Oil concentrate of an olefin copolymer | 11.70 |
| Silicon antifoamant | 150 ppm |

The oils containing the subject additive were then tested in the Small Engine Friction Test[1] which measures the relative antifrictional effect of oils. In this work, the reference oil (Oil A in Table II) is the above conventional motor oil formulation to which no friction modifier has been added. Oil B (Table II) is the above conventional motor oil to which was added a minor friction reducing amount (0.7±0.1 wt. %) of a commercial friction modifier. The results given in the Table II show that the subject composition is a very effective friction-reducing agent at a very low concentration.

[1] The friction modifiers were blended into the oil at the dosages shown.

TABLE II

| Friction Tests on Oil Blends Containing The Subject Composition | | | |
|---|---|---|---|
| | Friction Modifier[1] | | |
| Oil | Example No. | wt. % | SEFT (Friction, %)[2] |
| A | — | 0 | 0 |
| B | — | 0.7 ± 0.1 | −4.9 |
| C | I | 0.5 | −8.2 |

[1]The friction modifiers were blended into the oil at the dosages shown.
[2]As measured by the torque exerted on motoring the engine at 280° where boundary lubrication prevails. The negative sign indicate a reduction in motoring torque.

Substantially similar products are obtained when sodium hydroxide is replace with potassium hydroxide.

The lubricant compositions containing the additive of the present invention are prepared by admixing same in suitable blending equipment, using conventional techniques, with a lubricating oil. The particular base oil is selected on the basis of its contemplated application and can also contain other conventional additives in an amount sufficient to fulfill each additives purpose. Such additives may include oxidation inhibitors dispersants, viscosity improvers, rust inhibitors, anti-foam agents, stabilizers, extreme pressure agents and the like. Generally the amount of the additives of this invention used in the lubricating oil will vary from 0.2 to 25 percent by weight and preferably from 0.5 to 10 percent by weight. The resultant lubricant compositions contain between 0.005 to 5.0% by weight of sodium or potassium.

It may be advantageous to form concentrates of the additives wherein the additives are prepared in the same lubricating oil as will be used in making the final dilute lubricant composition and containing from 10 to 60 percent by weight of the oils described below and from 90 to 40% by weight of at least one of the salts defined by the above general formula.

Lubricating oils according to this invention generally comprise a major amount of any of the well-known types of oils of lubricating viscosity ranging from 50 to 5000 SUS at 38° C. as suitable base oils. These include hydrocarbon or mineral lubricating oils of naphthenic, paraffinic, and mixed naphthenic and paraffinic types. The oils may be refined by any one of the conventional methods such as solvent refining and acid refining. Synthetic hydrocarbon oils of the alkylene polymer type or those derived from coal and shale may also be employed. Alkylene oxide polymers and their derivatives such as the propylene oxide polymers and their ethers and esters in which the terminal hydroxyl groups have been modified are also suitable. Synthetic oils of the dicarboxylic acid ester type including dibutyl adipate, di-2-ethylhexyl sebacate, di-n-hexyl fumaric polymer, di-lauryl azelate, and the like may be used. Alkyl benzene types of synthetic oils such as tetradecyl benzene, etc., also can be used.

The additives of the invention are not to be confused with the antiwear agents of the prior art in that they exert a "cushioning effect" between moving metallic parts of an engine and, in that sense, providing fuel economy in vehicles powered by internal combustion engines. This friction-reducing concept is totally different from a purely antiwear effect and the two are not synonymous. In fact, there are data available which clearly demonstrate that a zinc dialkyldithiophosphate (the most common type of anti-wear agent) can actually cause a significant increase in friction when added to an oil formulation.

It is not intended that this invention be limited to the specific examples or modifications which have been given above merely for the sake of illustration nor necessarily by any theory as to the mechanism of the operation of the invention but only by the appended claims which include all novelty inherent in the invention.

What we claim is:

1. A friction-reducing additive for lubricating oils having the formulas:

$$RNHCH_2CH_2CO_2^-X^+ \text{ and } RNHCH_2CH_2CONH_2$$

wherein R is a straight chain radical having from 10 to 30 carbon atoms and X is sodium or potassium.

2. The product of claim 1 wherein R is oleyl and X is sodium.

3. The product of claim 1, wherein R is cocoyl.

4. The product of claim 1, wherein R is tallow.

5. The product of claim 1, wherein R is soya.

6. A lubricating oil comprising a major amount of an oil of lubricating viscosity friction-reduced by the presence therein of from 0.10 to 50.00 percent by weight of a product according to claim 1.

* * * * *